US005619919A

United States Patent [19]

Karlyn et al.

[11] Patent Number: 5,619,919

[45] Date of Patent: Apr. 15, 1997

[54] SILK-SCREEN PRINT HEAD FOR THE PRINTING OF HALFTONES ON THE SURFACE OF A SUBSTRATE

[75] Inventors: William M. Karlyn, Lynnfield; Edward J. Berry, Revere; James J. McGrath, Townsend, all of Mass.

[73] Assignee: Autoroll Machine Corporation, Middleton, Mass.

[21] Appl. No.: 388,105

[22] Filed: Feb. 13, 1995

[51] Int. Cl.[6] ..... B41F 15/08

[52] U.S. Cl. ..... 101/123; 101/115; 101/129

[58] Field of Search ..... 101/115, 123, 101/124, 126, 129, 35

[56] References Cited

U.S. PATENT DOCUMENTS

| | | | |
|---|---|---|---|
| 4,648,317 | 3/1987 | Bubley et al. | 101/123 |
| 5,127,321 | 7/1992 | Proffer | 101/123 |
| 5,158,016 | 10/1992 | Dubuit | 101/123 |
| 5,165,340 | 11/1992 | Karlyn et al. | 101/126 |
| 5,438,922 | 8/1995 | Bubley et al. | 101/123 |
| 5,456,169 | 10/1995 | Rohwetter et al. | 101/35 |

*Primary Examiner*—Ren Yan
*Attorney, Agent, or Firm*—Herbert L. Gatewood

[57] ABSTRACT

A print head for silk-screen printing apparatus is provided. The silk-screen frame and squeegee of the print head are fixedly connected together to provide that the two move together in rotational manner. Thus, the squeegee can be made to always print across the square-shaped mesh of the woven screen rather than across diamond-shaped mesh whereby to eliminate or at least minimize or localize moire. The silk-screen frame and squeegee can be rotated together to a predetermined angle or degree, in advance of the printing of a particular color in the silk-screen printing of halftones.

14 Claims, 4 Drawing Sheets

SILK-SCREEN PRINT HEAD FOR THE PRINTING OF HALFTONES ON THE SURFACE OF A SUBSTRATE

BACKGROUND OF THE INVENTION (1). Field of the Invention

This invention relates, in general, to silk-screen printing apparatus. More particularly, the invention relates to a silk-screen print head for use in a multicolor halftone silk-screen printing process, such as the four-color silk-screen printing of the surface of a compact disc.

(2). Description of the Prior Art

Silk-screen printing, in general, involves the use of a screen, i.e., a woven mesh fabric having a plain weave, stretched over a frame and the design or text to be printed is provided on the screen in outline form, in the nature of a stencil. The design to be printed is provided in the silk-screen, in general, by coating the screen with a photosensitive emulsion, exposing the emulsion to a source of light to obtain the desired image and then washing the unexposed areas to leave the screen with the image to be printed. The design or text is reproduced on a desired object, e.g., the surface of a compact disc, by having a squeegee force color, i.e., ink, through the mesh of the exposed areas of the screen. Thus, the image or text printed on the surface of an object comprises a plurality of closely spaced dots of color.

In general, the silk-screen frame and squeegee are mounted to the print head independently of one another. The screen frame is provided with means for movement of the frame in an x-y-z direction, relative to the object to be printed, e.g., the top surface of a compact disc located in the horizontally disposed well of a disc fixture. The screen frame is of a square or rectangular shape defined by parallel side edges and parallel, opposed inner and outer end edges. The squeegee is mounted so as to move linearly relative to the inner and outer end edges of the screen frame. Where the screen frame is moved only in an x-y direction, the squeegee, in general, moves across the woven fabric screen located in the screen frame in a manner such that it's movement is square with respect to the square mesh defined by the screen. Nevertheless, if the screen frame has needed to be rotated relative to the surface to be printed and the image to be printed thereon, the squeegee will then travel across diamond-shaped mesh rather than square-shaped mesh in the woven screen. This leads to a distortion in the dots of color being printed. As a result, a moire' interference pattern occurs in the printed image. Moire', in general, manifests itself in an unsuitable shimmering pattern or wave-like appearance.

Another problem resulting from the rotation of the screen frame to register the image to be printed, relative to the surface to be printed, is that such rotation can be inhibited by the size of the screen frame. This results from the fact that the travel of the squeegee, in silk-screen printing, is fixed, i.e., the squeegee travels in a linear direction between the sides of the screen frame, while the travel of the screen frame is not. Thus, the desired rotation of the screen frame may necessitate the use of a larger size screen frame than desired so that the squeegee can fit within the side edges of the frame. Going to a larger size screen, however, can result in having to provide everything in the silk-screen printing apparatus of a somewhat larger size. This is generally undesirable, as it is likely to increase the cost of the apparatus. Moreover, it usually is most preferred to keep such equipment in as compact an area as possible, particularly if space is limited.

Halftone printing, contrary to full color printing, involves a shading or gradation of color. In such printing, the gradation of the tone of color is obtained by a system of closely spaced dots of color arranged in parallel lines, i.e., rows and columns of dots of color. For example, in the four color printing of the surface of a compact disc, this involves the separate printing of a line of dots of cyan, black, magenta, and yellow of full color, in turn. The dots of different color being printed need be provided in proper linear registration in respect to one another to provide not only the desired gradation of color but also to prevent moire'. Thus, the lines of dots of color are intended to be provided on the surface of the object being at predetermined angles, e.g., the angles of color separation, so that the lines of dots do not cross one another.

Heretofore, the manner of eliminating, or at least reducing or localizing, moire' in the silk-screen printing of halftones has been most difficult. One method suggested heretofore has been to mount the printing head so that it can be moved in an x-y-z fashion, relative to the object to be printed, e.g., the top surface of a compact disc. Thus, with rotational movement of the print head, the squeegee can still be made to move across the mesh of the screen in a square manner, i.e., the squeegee moves across squares rather than diamonds, and the lines of dots of color are printed at the desired angles of color separation. This procedure, however, has proved less than satisfactory. Such a manner of printing requires that, for example, a compact disc to be silk-screen printed be provided on a puck. The disc/puck combination is then loaded by hand at each print head for each different color to be printed. The print heads, in this case, are previously rotated to the desired angle relative to the surface to be printed and the color to be applied at that particular printing station. This manner of printing, as will be readily appreciated by those skilled in the art, does not readily lend itself to automation. This is not only time consuming but leads to an inefficient and costly manner of operation. Moreover, where the print head is itself mounted to be rotatable this tends to limit the number of print heads that can be provided in any particular silk-screen printing apparatus. This is due to the size of a conventional print head and the area that must be provided for the print heads to be rotatable. The more print heads provided, the larger the area that would be required to accommodate the rotatable print heads, the support member for the print heads and the associated transport member.

Another manner of eliminating, or at least minimizing or localizing moire' has been to change the angle of the mesh in the woven fabric screen relative to the screen frame, i.e., providing the mesh of the screens in the frames at the angles of color separation. Thus, when the screen frame is mounted to the print head, the mesh of the screen will be properly oriented so that the angles of color separation are not only taken into consideration but the squeegee will move across the mesh of the screen in a square manner. Although this manner of eliminating moire' in halftone printing is, in general, satisfactory, the providing of such screens is not totally satisfactory. Due to the limitations of conventional print heads the mesh in the screen cannot exceed a 15° rotation in either direction. Where the screen frame is rotated to a greater extent than 15°, the squeegee is again printing across diamond-shaped mesh rather than square-shaped mesh. In such a case, the squeegee may not, at least in some instances even fit within the screen frame, as earlier disclosed. Furthermore, this manner of at least minimizing or localizing moire' is a somewhat costly proposition.

In the conventional manner of providing silk-screens, in general, a square cut of a woven fabric is stretched to the extent desired. Screen frames are then placed under the stretched fabric in side-by-side manner, after which the stretched fabric is adhesively secured to the flames. The screens are then provided by cutting around the outside edges of the frames. In such a process, there is little, if any wastage of fabric, as the frames are provided in close association with one another. Nevertheless, where the mesh of the woven screens is to be provided in the frames at predetermined angles of color separation, the screen frames must necessarily be spaced apart from one another. This can result in considerable wastage of fabric from which the screens are made, leading to increased cost for a set of screen to be used in halftone printing.

Another means of possibly eliminating moire' in any particular silk-screen printing operation is to change to a fabric with a different mesh count. Nevertheless, this is not a desirable solution. The manufacture of a set of silk-screens for halftone printing is a somewhat costly and labor intensive operation. Where moire' occurs, the making of a new set of screens with different mesh woven fabric merely compounds this expense to a printer.

Thus, it is highly desired to provide silk-screen printing apparatus whereby moire' can be eliminated, or at least localized or minimized, in a more efficient and less costly manner.

SUMMARY OF THE INVENTION

The present invention has as a primary object the providing of apparatus for the multicolor silk-screen printing of halftones on a surface not attendant with the problems and disadvantages in the use of such apparatus heretofore.

A further object of the invention is to provide improved means for the orienting of a silk-screen frame relative to a surface to be silk-screen printed whereby moire' is eliminated, or at least minimized or localized.

A still further object of the invention is to provide improved means for placement of a silk-screen frame at the best angle relative to a surface to be silk-screen printed in the halftone printing of the surface whereby moire' will be eliminated, or at least minimized or localized.

Another object of the invention is to provide an improved printing head for use in the silk-screen printing of halftones and for the elimination, or at least minimization or localization, of moire' whereby the manufacture of silk-screens for such purpose can be simplified.

A still further object of the invention is to provide an improved printing head for use in the silk-screen printing of substrates wherein a silk-screen conventionally manufactured can be used, i.e., the mesh of the screen are provided square in the screen frame.

A still further object of the invention is to provide an improved printing head for use in the halftone printing of substrate surfaces wherein moire' is eliminated, or at least minimized or localized, and the screen used in such a printing head comprises a square piece of a woven fabric stretched in the conventional square manner.

An even further object of the invention is to provide an improved print head for use in automatic silk-screen printing apparatus whereby moire' can be eliminated, or at least minimized or localized, in the halftone printing of the surface of a substrate.

A still further object of the invention is to provide a print head wherein a screen frame of the smallest footprint can be accommodated.

Yet another object of the invention is to provide a process whereby moire' in the silk-screen printing of a substrate surface can be more readily eliminated or at least minimized or localized.

A still further object of the invention is to provide a means and process of silk-screen printing wherein a silk-screen frame can be rotated at an angle of more than 15° relative to the surface of the object to be printed and the color being printed by a particular print head.

The above objects and others not mentioned herein are accomplished, in general, in the providing of a print head for use in the silk-screen printing of multiple colors on the surface of a substrate wherein the silk-screen frame and squeegee are mounted to the print head so as to move in unison with one another when one or the other of the silk-screen frame or squeegee is moved in a rotary manner relative to the surface to be printed.

BRIEF DESCRIPTION OF THE DRAWINGS

For a better understanding of the present invention and its preferred embodiments, reference should be made to the following detailed description of the invention and its preferred embodiments which is to be read in conjunction with the accompanying drawings, in which.

DETAILED DESCRIPTION OF THE INVENTION AND THE PREFERRED EMBODIMENTS THEREOF

While the present invention will be described hereinafter with particular reference to the accompanying drawings, it is to be understood at the outset that it is contemplated that the present invention may be varied in specific detail from that illustrated and described herein while still achieving the desirable characteristics and features of the present invention. Accordingly, the description which follows is intended to be understood as a broad enabling disclosure directed to persons skilled in the applicable arts and is not to be understood as being restrictive.

Figure 1:
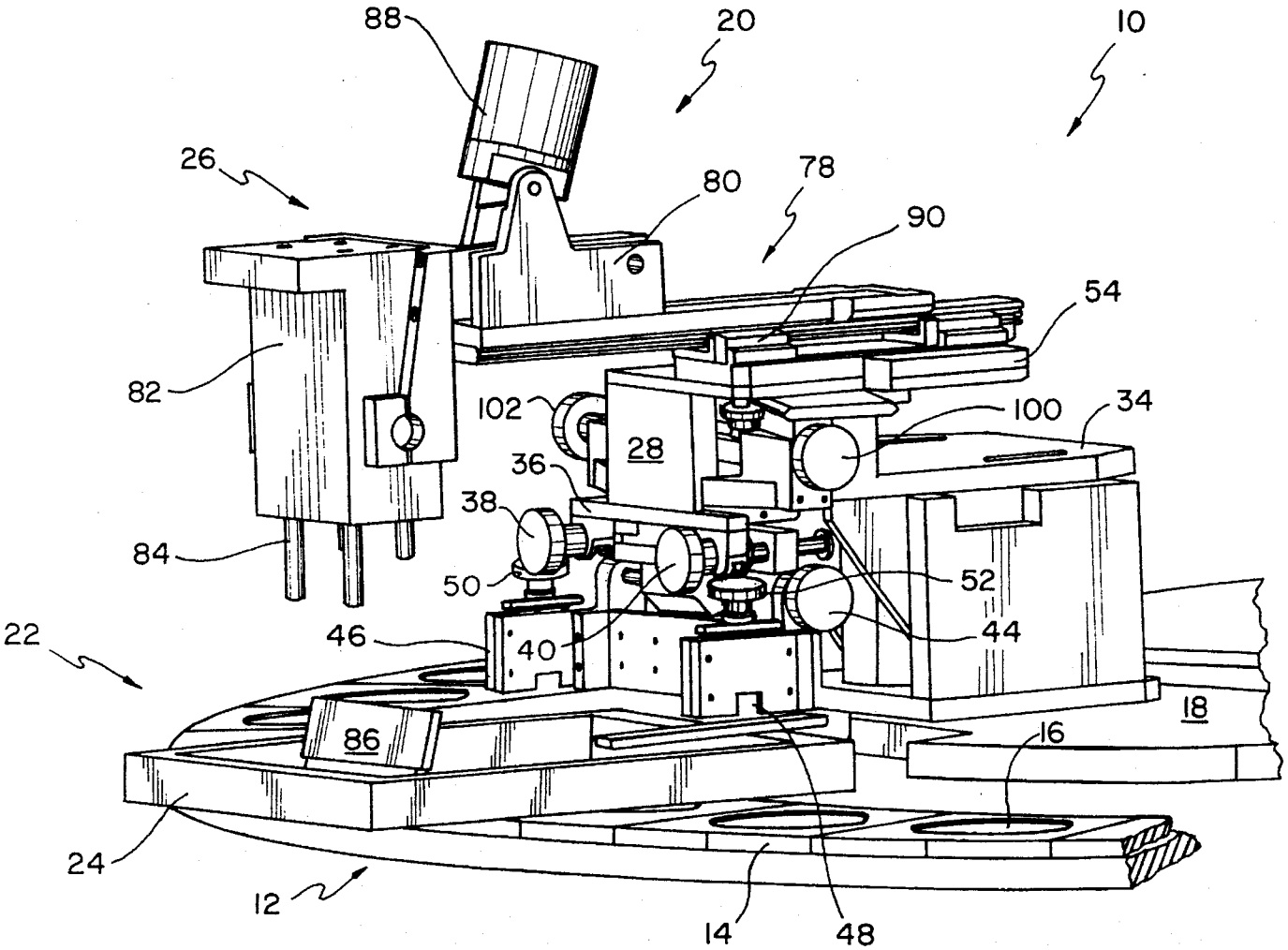
FIG. 1 is a partial perspective view of silk-screen printing apparatus for the multicolor printing of compact discs in which is shown a portion of an annular-shaped rotatable transport member, a portion of an annular-shaped fixed support member for supporting a plurality of print heads located above the rotatable transport member, and a print head according to the invention, located on and supported by the fixed support member.

Turning now to FIG. 1 of the drawing, there is shown therein silk-screen printing apparatus 10 for the multicolor silk-screen printing of compact discs. The silk-screen printing apparatus 10 comprises an annular-shaped, horizontally disposed, rotatable transport member 12 on the top surface of which are provided, in predetermined spaced-apart locations, a plurality of compact disc fixtures referred to generally by reference numeral 14. The disc fixtures 14 are each provided with a horizontally disposed well 16 in which is located a compact disc ( not shown in the drawing).

Located above the annular-shaped rotatable transport member 12 and in a horizontally disposed plane parallel to that defined by the transport member is an annular-shaped fixed support member 18 for the support of a plurality of silk-screen print heads referred to, in general, by reference numeral 20. Although only one print head is shown in the drawing, it will be appreciated by those skilled in the art that a plurality of print heads will be provided on and supported by the support member 18, the specific number of which depends upon the number of different colors being printed.

None of the above members of the silk-screen printing apparatus are of any particular significance to the invention later more specifically disclosed herein, except as to any specific disclosure made hereinafter. The various members above mentioned are disclosed in U.S. Pat. No. 5,165,340, which issued to William M. Karlyn et al on Nov. 24, 1992, this patent being owned by Autoroll Machine Corporation the same as is the invention more particularly later disclosed, the disclosure of which patent is fully incorporated herein.

The print head 20 comprises, in its basic aspects, a silk-screen member 22 comprising a silk-screen frame member 24 and a silk-screen (not shown ) fixedly secured to the frame member in conventional manner, and a squeegee assembly 26. The silk-screen member 22 is provided with a silk-screen, according to usual techniques, comprising a plain weave fabric conventionally used for silk-screen printing, for example, a plain weave polyester fabric. The woven fabric mesh size best suited for the silk-screen printing operation to be performed can vary and can readily be chosen by one skilled in the art of silk-screen printing. The fabric is, in general, prior to being fixedly attached to the screen fame, cut to the desired size, depending upon the stretching apparatus being used. The fabric is placed in the stretching apparatus and stretched in square manner, i.e., the opposed ends of the respective warp and weft threads are pulled in opposite directions. Those skilled in the art will readily appreciate the great advantage in being able to use in a print head, in accordance with the invention, silk-screen members conventionally made. Thus, screen members can be provided in simple manner and at less cost.

Figure 2:
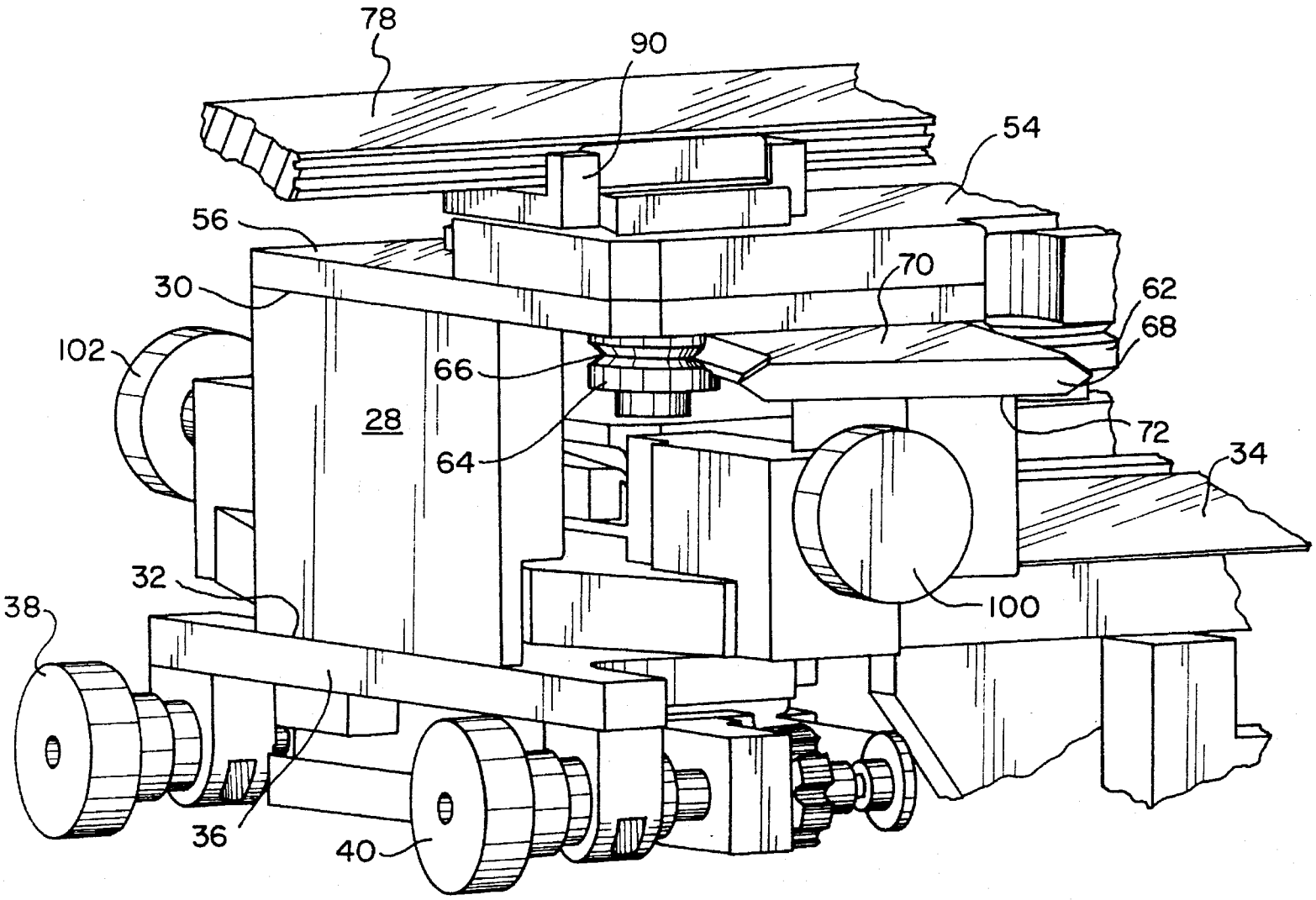
FIG. 2 is an enlarged perspective view showing the mounting of the silk-screen frame and squeegee assembly in fixed relationship to one another whereby the two members can be caused to move together in unison in a rotary manner, and the means for tracking that rotary movement.
Figure 3:
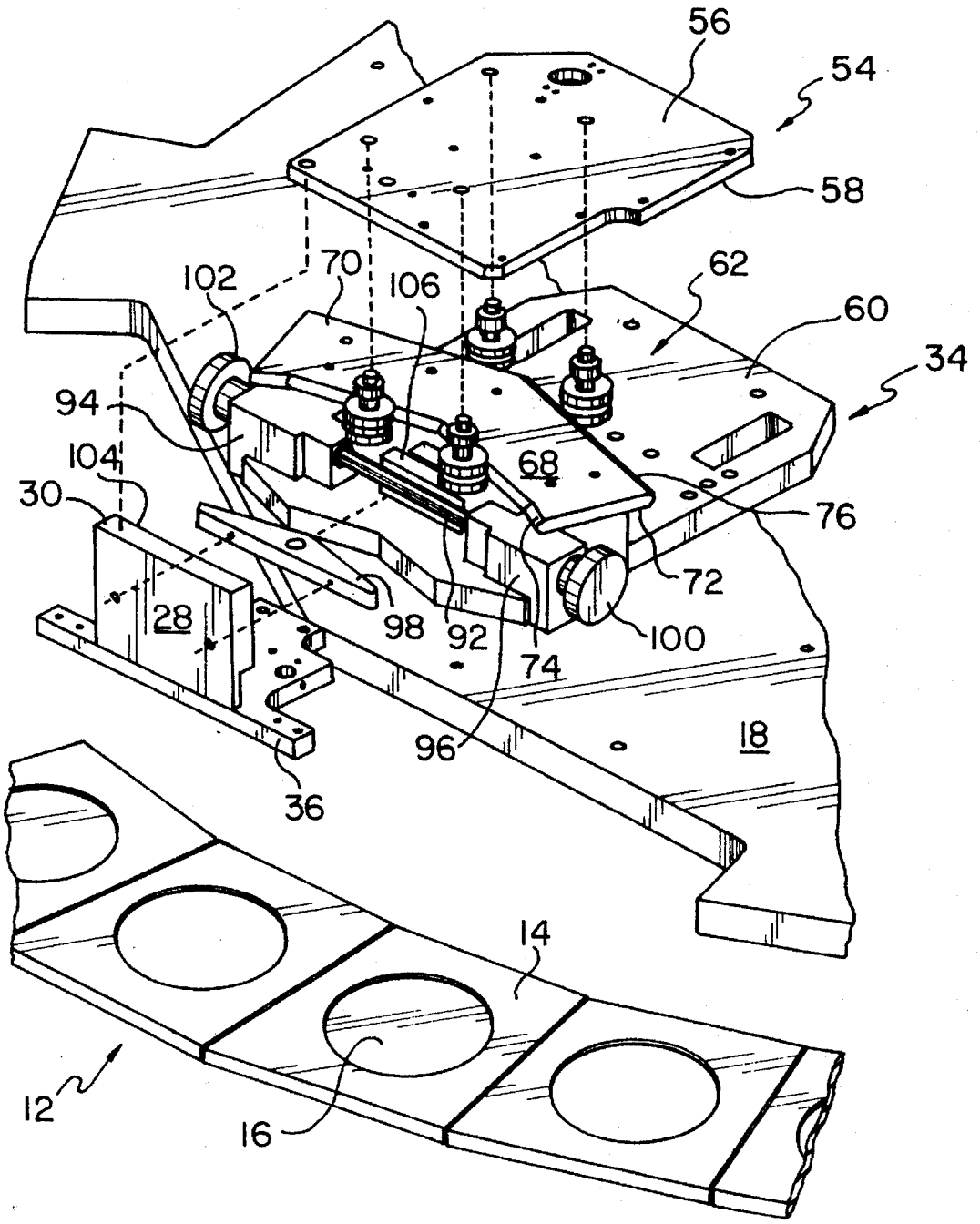
FIG. 3 is an enlarged perspective view showing the means for mounting the silk-screen frame and squeegee in fixed relationship together and to the print head whereby to provide that the two members move in unison in a clockwise or counterclockwise manner and the means for tracking that movement.
Figure 4:
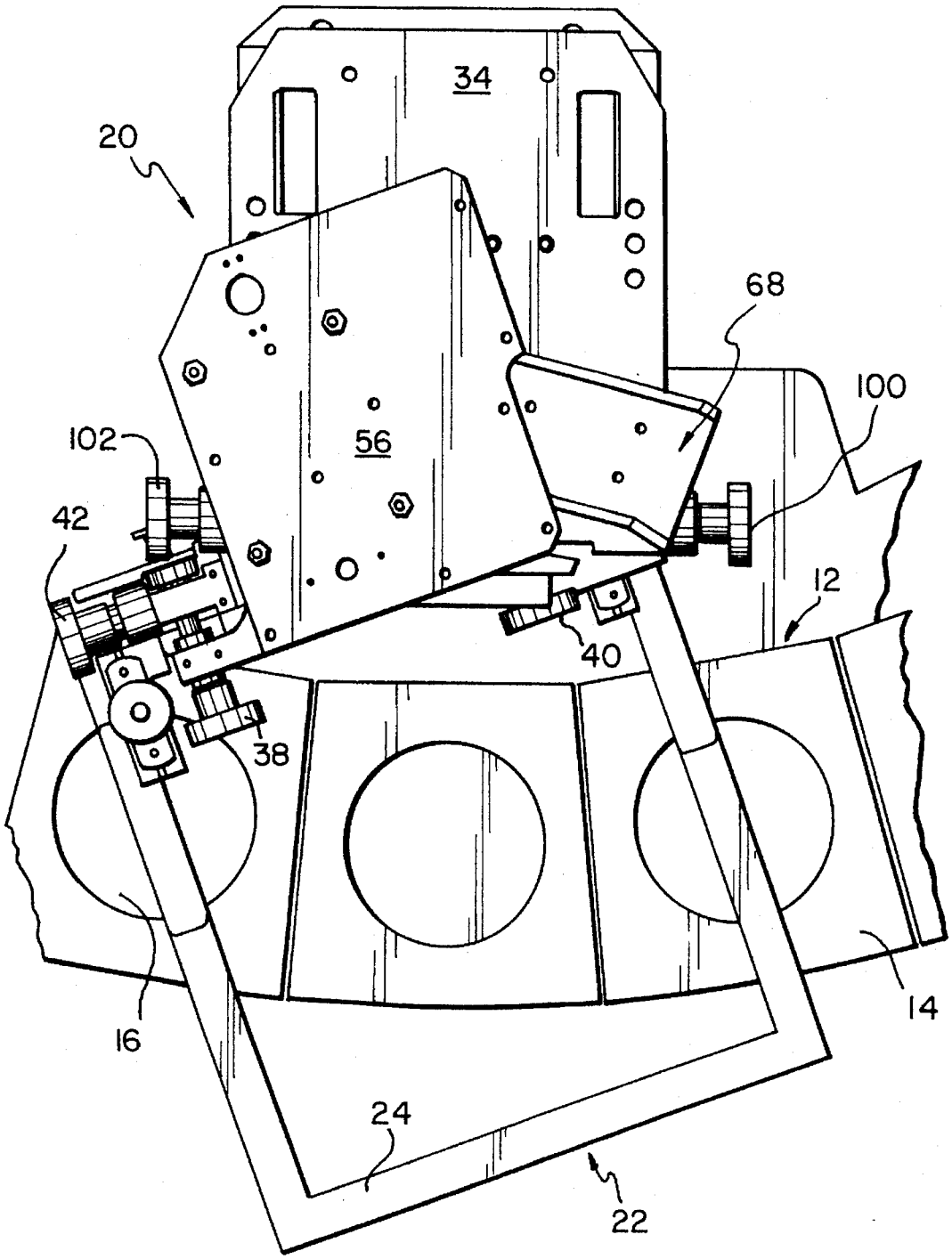
FIG. 4 is a plan view of the print head shown in FIG. 1 wherein the squeegee assembly has been removed but better showing the silk-screen frame skewed at an angle of 20° relative to the compact disc to be silk-screen printed.

As will be more readily appreciated by reference to FIGS. 2 and 3 of the drawing, the print head 20 comprises a vertically disposed hangar plate 28 defined by top and bottom ends 30, 32 (FIG. 2). The hanger plate 28 is provided with an inset adjacent its bottom end, as shown in the drawings, whereby to fit closely with the outwardly curved front edge of the horizontally disposed support member 34. The bottom end 32 of the hangar plate is fixedly attached to a screen frame mount assembly comprising a horizontally disposed mounting plate 36.

Mounted to the screen frame mount assembly are screen frame adjustment members 38, 40 and 42, 44 whereby the screen frame can be adjusted along an x-y axis, according to usual manner. Thus, with adjustment members 38, 40 the location of the screen frame can be adjusted inwardly or outwardly from the print head, i.e., along the y-axis, relative to the location of the compact disc being silk-screen printed. The adjustment members 42, 44 can be used to adjust the location of the screen frame laterally, i.e., along the x-axis, relative to the compact disc being printed. At the bottom of the screen frame mount assembly are mounted means comprising vertically disposed, spaced-apart members 46, 48 in which are provided adjustment members 50, 52, for adjusting the vertical distance of the screen frame 24 from the top surface of the compact disc fixtures 14 in the wells of which are located the compact discs having been previously registered for printing. The various adjustment members provided in the mount assembly and used in the practice of this invention are antibacklash precision adjustment members conventionally used for the adjustment of silk-screen frames mounted to a conventional silk-screen print head and form not part of this invention. Neither does the screen frame mount assembly other than as particularly disclosed hereinafter.

The top end of the hangar plate 28, and such a plate is a critical aspect of the invention, is fixedly connected to the outer end of the horizontally disposed skew plate 54 defined by top and bottom planar surfaces 56, 58 in parallel disposition to one another and to the top surface 60 of the support plate 34. To the bottom surface of the skew plate there is connected a plurality of freely rotatable rollers, these rollers being referred to in the drawing, in general, by reference numeral 62.

As will best appreciated by reference to FIG. 3 of the drawing, the rollers 62 are provided in two rows, two rollers in each row. Although in the practice of the invention, only two rollers have been provided in each row, more than two can be provided, if desired. It is critical, as will be better appreciated later, however, that at least two rollers be provided in each row. The rollers 62 are each defined by top and bottom ends and by a peripheral surface denoted generally by reference numeral 64 and by a center of rotation. In the peripheral surface of each roller, there is provided an inwardly extending V-shaped groove 66, the purpose for which will soon be made clear.

The diameter of the rollers 62 is of no particular consequence in the practice of the invention. The rollers should, however, be kept to a relatively small diameter so that the overall dimensions of the print head can be kept to its usual size. The center of rotation or centerpoint of the rollers in each row of rollers will be provided on outwardly facing arcs of two concentric circles having the same centerpoint as that of a compact disc to be printed, the reason for which will be later disclosed.

Located between the two rolls of rollers 62, as can best be seen from FIG. 3, is a horizontally disposed tracking member 68. The tracking member 68 is defined by top and bottom planar surfaces 70, 72 and by curved V-shaped front and back edges 74, 76. These V-shaped front and back edges are engaged, respectively, in the V-shaped grooves 66 provided in the rollers 62 in the front and back rows of rollers. The curved front and back edges of tracking member 68, and such is deemed a critical aspect of the invention, are defined by arcs of concentric circles having the same centerpoint as the center of the wells 16. Thus, it will be appreciated by those skilled in the art that the centers of rotation of the rollers 62 must necessarily have the same center of rotation as the centerpoint of the well or nest 16 of a disc fixture 14.

Referring now to FIGS. 1 and 2, it will be seen that the squeegee assembly 26 is mounted to the front end of a slide member 78 conventionally used in mounting a squeegee assembly to a silk-screen print head. The squeegee assembly 26 comprises mounting member 80 by which the squeegee assembly is fixedly mounted to the slide member according to usual techniques. At the front end of the mounting member 80 is mounted in conventional manner the squeegee head 82. Depending vertically downwardly from the squeegee head 82 are connecting arms 84 to the bottom ends of which is connected a squeegee 86 according to usual manner. This connection is not actually shown in the drawing for sake of clarity and because it forms not part to the instant invention. The squeegee assembly 26 is further provided with conventional piston means 88 whereby the squeegee head can be pivoted upwardly and downwardly, as desired.

The slide member 78 is located in usual fashion in bearing block 90 so that the slide member can be caused to slide back and forth by drive means not shown whereby the squeegee head is caused to travel inwardly and outwardly in usual manner during the print cycle. The bearing block 90 for the slide member 78 is fixedly connected at its bottom surface to the top surface 56 of the skew plate 54. Thus, it will be appreciated by those skilled in the art that the squeegee assembly and the silk-screen frame are fixedly connected to one another.

Turning now to FIG. 3, there is shown a worm gear 92 the extensions of which are mounted for rotation in bearing blocks 94, 96. These bearing blocks are fixedly connected in opposed relationship at the front of support member 34. The worm gear 92 is operatively connected to the gear 98 which, in turn, is fixedly connected to the back side 104 of hanger plate 28. The gear 98 is a segment of a conventional round gear. Importantly, the circle defining the gear 98 has the same centerpoint as that of a nest 16.

As the worm gear 92 is caused to rotate by either of the adjusting knobs 100, 102, conventional antibacklash adjustment members, the squeegee assembly and screen frame will be caused to rotate together and to the same extent. Thus, no matter what the amount of rotation and whether it is clockwise or counterclockwise, the squeegee will always, during the print cycle, be caused to travel in a linear fashion across the silk-screen and across square openings in the silk-screen, rather than diamonds. As shown in the drawing, there is provided in operative combination with the worm gear 92 a worm gear spring back block 106 in which is provided an inwardly extending arcuate surface for location of the worm gear. This block functions to maintain the worm gear 92 in operative contact with the teeth of the gear 98, in usual fashion. The diameter of the worm gear is of no particular consequence to the practice of the invention, except that its diameter must be such as to mate with the gear 98. Worm gears commercially available are suitable for use in the practice of the invention. It is believed that one skilled in the art can readily select a suitable worm gear for the purposes disclosed herein, as well as an operative gear segment 98. The selection will depend to some extent, of course, upon the degree output desired by each rotation of the adjustment members 100, 102. Although not shown in the drawing, a suitable scale can be provided, if desired, for example, on the top surface of the tracking member 68, to show the degree output from the adjustment members 100, 102.

The extent or degree of rotation of the silk-screen frame and squeegee desired for any particular print head will depend upon the particular color, i.e., lines of dots of color being printed by that print head. This will be determined by the angle of color separation. Nevertheless, it is most desirable that the silk-screen frame and squeegee in any particular print head be capable of being rotated in either a clockwise or counterclockwise manner at least about 20°. This can readily be accomplished and is believed well within the skill of those skilled in the art.

In the practice of the invention, in general, the print heads are each first set up in usual manner for the particular color to be printed. The screen frame and squeegee are then provided at the desired angle for the color being printed. This is accomplished by rotating one or the other of the adjusting knobs 100, 102, as required, until the desired degree of rotation is obtained. Thus, the hangar plate 28 is caused to travel along the curved front edge of the support member in the desired direction. The compact discs are then each loaded, in turn, into the compact disc fixtures provided on the top surface of the rotatable, annular-shaped, transport member. The loading of the discs can be accomplished by the means disclosed in U.S. Pat. No. 5,165,340, or by other means as desired.

As will be understood by those skilled in the art, various modifications and changes can be made in the invention and its form and construction without departing from the spirit and scope thereof. The embodiments of the invention disclosed herein are merely exemplary of the various modifications that the invention can take and the preferred practice thereof. It is not, however, desired to confine the invention to the exact construction and features shown and desired herein, but it is desired to include all such as properly come within the spirit and scope of the invention disclosed and claimed.

What is claimed is:

1. A print head for use in the silk-screen printing of halftones on the surface of a circular-shaped compact disc, an annular-shaped rotatable transport member defined by a top surface, a compact disc fixture being provided on said top surface, a well being provided in said compact disc fixture, said well being defined by a circular-shaped peripheral surface and a centerpoint comprising:

(a) a squeegee assembly comprising a horizontally disposed elongated slide member defined by a front end and a back end and a squeegee being mounted to the front end of the slide member;

(b) a horizontally disposed silk-screen frame, and a mounting means for said silk-screen frame comprising a horizontally disposed mount plate defined by a front edge;

(c) a horizontally disposed skew plate defined by top and bottom planar surfaces and by a front edge, the top surface of said skew plate being connected to the slide member;

(d) a vertically disposed hangar plate defined by top and bottom edges and by a front side and a back side, said top edge of the hangar plate being fixedly connected to said skew plate and the bottom edge of the hangar plate being fixedly connected to the mount plate of the silk-screen frame mounting means whereby the squeegee assembly and silk-screen frame are fixedly connected together and will on rotation of said squeegee assembly cause the same rotation in said silk-screen frame; and (e) means for causing rotation of said squeegee assembly.

2. A print head according to claim 1 wherein the means for causing rotation of the squeegee assembly comprises:

(a) a circular-shaped gear segment fixedly connected to the back side of said hangar plate; and (b) a worm gear operatively associated with the gear segment whereby on rotation of the worm gear the hangar plate will be caused to rotate which, in turn, causes rotation of the silk-screen frame and squeegee assembly connected to the hangar plate.

3. A print head according to claim 2 wherein the means causing rotation of the squeegee assembly further comprises:

(a) a horizontally disposed tracking member being fixedly connected to the bottom surface of said skew plate, said tracking member being defined by top and bottom surfaces and by front and back curved edges, the front and back curved edges defining V-shaped curved edges defined by arcs of concentric circles, said concentric circles having a center point the same as the centerpoint of said well; and (b) a plurality of freely rotatable rollers extending downwardly from the bottom of the skew plate and being fixedly connected to the skew plate, each of said plurality of rollers being defined by a vertically disposed peripheral surface and a V-shaped groove extending inwardly into the peripheral surfaces, said plurality of rollers being arranged in front and back rows of rollers, the V-shaped grooves in the rollers in respective front and back rows being operatively engaged with said V-shaped front and back curved edges of the tracking member.

4. Apparatus for the silk-screen printing of multiple colors on the surface of a substrate comprising, in combination:

(a) a plurality of print heads each comprising a silk-screen frame and a squeegee assembly;

(b) means mounting each said silk-screen frame and squeegee assembly fixedly together so that the two are caused to be moved in unison with one another; and (c) means provided in operative combination with each said squeegee assembly for causing rotation of each said silk-screen frame and squeegee assembly together, said means for causing rotation of the squeegee assembly comprising:

(1) a horizontally disposed skew member defined by top and bottom planar horizontally disposed surfaces mounted to the squeegee assembly;

(2) a horizontally disposed tracking member defined by top and bottom planar surfaces and by inner and outer arcuate-shaped edges parallel to one another, said inner and outer arcuate-shaped edges each being further defined by a V shaped edge; and (3) a plurality of freely rotatable circular-shaped rollers each being defined by a circular-shaped peripheral surface and a center of rotation, the circular-shaped peripheral surface of each said roller terminating in planar end surfaces in parallel disposition to one another, and an inwardly extending V-shaped groove being provided between said end surfaces, said rollers being mounted to the bottom surface of said skew member in front and back rows with the ends of a roller being provided in parallel disposition to the bottom planar surface of the skew member, the V-shaped front and back edges of said tracking member being engaged in the V-shaped grooves in the rollers.

5. Apparatus for the multicolor silk-screen printing of the top surface of a plurality of compact discs one after the other, each compact disc being defined by a top and bottom planar surface, said apparatus comprising in combination:

(a) an annular-shaped horizontally disposed rotatable transport member defined by predetermined inner and outer diameters and by a center of rotation;

(b) a plurality of compact disc fixtures being provided on the transport member in predetermined spaced-apart locations, each said disc fixture being defined by a horizontally disposed planar top surface, a circular-shaped well being provided in each said disc fixture and extending inwardly from the top surface of the disc fixture for holding a compact disc in horizontally disposed manner for the silk-screen printing of the top surface of the compact disc, the top surface of the compact disc being in the same horizontally disposed plane as the top surface of the disc fixture and the circular-shaped well being defined by a centerpoint;

(c) an annular-shaped horizontally disposed support member defined by top and bottom parallel planar surfaces and being located in a plane above the plane defined by the rotatable transport member, said support member being defined by predetermined inner and outer diameters, the outer diameter of the support member being less than the outer diameter of the rotatable transport member, the support member and rotatable transport member being in concentric relationship with another;

(d) a plurality of print heads corresponding to the number of colors to be printed being mounted on the support member, each print head comprising a horizontally disposed silk-screen frame defined by parallel side edges and by inner and outer end edges, and a squeegee assembly comprising a squeegee mounted above the silk-screen frame for movement in a direction between the end edges of the silk-screen frame, the print head being so mounted on the support member that the silk-screen frames of the print heads face outwardly from the center of rotation of the rotatable transport member, mounting means for mounting each said silk-screen frame to each of said plurality of print heads, said mounting means comprising a horizontally disposed mounting plate defined by a front edge, a horizontally disposed slide member being mounted to said squeegee assembly for movement of the squeegee assembly inwardly and outwardly across the annular-shaped rotatable member, and a vertically disposed hangar plate defined by horizontally disposed, parallel top and bottom edges, said top edge of the hangar plate being connected to the slide member and said bottom edge of the hangar plate being connected to said mounting plate;

(e) means fixedly connecting the silk-screen frame and squeegee assembly of a print head together so that rotational movement of one of said silk-screen frame and squeegee assembly causes movement in the other of the silk-screen frame and squeegee assembly in the same direction and to the same degree; and (f). means in operative association with one of the silk-screen frame and squeegee assembly of a print head for causing rotational movement of one of said silk-screen frame and squeegee assembly of a print head.

6. Apparatus according to claim 5 wherein the means causing rotation of one of said silk-screen frame and squeegee assembly of a print head causes rotation of said squeegee assembly and comprises:

(a). a horizontally disposed skew plate defined by top and bottom surfaces;

(b). a tracking member fixedly connected to the bottom surface of the skew plate defined by front and back edges of arcs of circles having the same center of rotation as the center point of a said well, said front and back edges being further defined by V-shaped edges; and (c). a plurality of freely rotatable rollers extending downwardly from the bottom of the skew plate, said plurality of rollers being arranged in parallel front and back rows of rollers defined by arcs of concentric circles, each said roller being defined by a vertically disposed peripheral surface and a V-shaped groove extending inwardly in said peripheral surface, the V-shaped front and back edges of said tracking member being in operative engagement with the V-shaped grooves in the rollers in the respective front and back rows of rollers.

7. Apparatus according to claim 5 wherein the means causing rotation of the squeegee assembly further comprises:

(a). a horizontally disposed support member defined by top and bottom planar surfaces and by a front edge;

(b). a pair of bearing blocks being mounted on said support member adjacent said front edge and in opposition to one another;

(c). a worm gear being mounted in horizontal disposition in said bearing blocks; and (d). a circular-shaped gear segment being provided in operative association with said worm gear, said gear member being fixedly connected to said means fixedly connecting said silk-screen frame and squeegee assembly together whereby on rotation of said worm gear the silk-screen frame and squeegee assembly will be caused to rotate together and to the same degree of rotation.

8. Process for the silk-screen printing of the surface of a substrate with a halftone comprising:

(a) providing a plurality of silk-screen print heads each comprising a silk-screen frame and a squeegee assembly and means fixedly connecting each said silk-screen frame and squeegee assembly together;

(b) providing a circular-shaped gear segment fixedly connected to the means connecting the silk-screen frame and squeegee assembly together;

(c) providing a worm gear in operative combination with said gear segment;

(d) rotating said worm gear whereby to cause rotation of the silk-screen frame and squeegee assembly together whereby to provide the silk-screen frame and squeegee assembly at a predetermined angle of rotation; and (c) silk-screen printing the surface of said substrate.

9. Apparatus for the silk-screen printing of multiple colors on the surface of a substrate comprising, in combination:

(a) an annular-shaped, horizontally disposed, rotatable transport member defined by a center point;

(b) a plurality of spaced-apart compact disc fixtures being provided on the rotatable transport member, each said compact disc fixture comprising a circular-shaped well, each said circular-shaped well being defined by a center point which lies on a circle having the same center point as the annular-shaped, horizontally disposed, rotatable transport member;

(c) a horizontally disposed support member, said support member being provided in a plane above that of the transport member;

(d) a plurality of print heads each comprising a silk-screen frame and a squeegee assembly being supported on said support member;

(e) means mounting each said silk-screen frame and squeegee assembly of said plurality of print heads together so that the silk-screen frame and squeegee assembly move together in rotational manner; and (f) means provided in operative combination with each said silk-screen frame and said squeegee assembly for causing rotation of each said silk-screen frame and squeegee assembly together, said means for causing rotation of each said silk-screen frame and squeegee assembly together comprising:

(1) a horizontally disposed skew member defined by top and bottom planar horizontally disposed surfaces mounted to the squeegee assembly;

(2) a horizontally disposed tracking member defined by top and bottom planar surfaces and by inner and outer arcuate-shaped edges each being defined by concentric circles having the same center point as the center point of said circular-shaped wells, said inner and outer arcuate-shaped edges each being further defined by a V shaped edge; and (3) a plurality of freely rotatable circular-shaped rollers each being defined by a circular-shaped peripheral surface and a center of rotation, the circular-shaped peripheral surface of each said roller terminating in planar end surfaces in parallel disposition to one another, and an inwardly extending V-shaped groove being provided between said end surfaces, said rollers being mounted to the bottom surface of said skew member in front and back rows with the ends of a roller being provided in parallel disposition to the bottom planar surface of the skew member, the center of rotation of the rollers in the front and back rows being provided on concentric circles each having the same center point as said annular-shaped rotatable member, the V-shaped front and back edges of said tracking member being engaged in the V-shaped grooves in the rollers.

10. Apparatus according to claim 9 wherein the means causing rotation of each said squeegee assembly comprises a worm gear and a gear segment and said worm gear and gear segment are in operative association.

11. Apparatus for the multicolor silk-screen printing of the top surface of a plurality of compact discs one after the other, each compact disc being defined by a top and bottom planar surface, said apparatus comprising in combination:

(a) an annular-shaped horizontally disposed rotatable transport member defined by predetermined inner and outer diameters and by a center of rotation;

(b) a plurality of compact disc fixtures being provided on the transport member in predetermined spaced-apart locations, each said disc fixture being defined by a horizontally disposed planar top surface, an annular-shaped well being provided in each said disc fixture and extending inwardly from the top surface of the disc fixture for holding a compact disc in horizontally disposed manner for the silk-screen printing of the top surface of the compact disc, the top surface of the compact disc being in the same horizontally disposed plane as the top surface of the disc fixture and the annular-shaped well being defined by a centerpoint;

(c) an annular-shaped horizontally disposed support member defined by top and bottom parallel planar surfaces and being located in a plane above the plane defined by the rotatable transport member, said support member being defined by predetermined inner and outer diameters, the outer diameter of the support member being less than the outer diameter of the rotatable transport member, the support member and rotatable transport member being in concentric relationship with another;

(d) a plurality of print heads corresponding to the number of colors to be printed being mounted on the support member, each print head comprising a horizontally disposed silk-screen frame defined by parallel side edges and by inner and outer end edges, mounting means for mounting said silk-screen frame to said print head, said mounting means comprising a horizontally disposed mounting plate defined by a front edge, and a squeegee assembly comprising a squeegee mounted above the silk-screen frame for movement of the squeegee in a direction between the end edges of the silk-screen frame, a horizontally disposed slide member mounted to said squeegee assembly for movement of said squeegee assembly inwardly and outwardly across the rotatable transport member and between the end edges of the silk-screen frame, a vertically disposed hangar plate defined by horizontally disposed, parallel top and bottom edges, said top edge of the hangar plate being connected to the slide member and said bottom edge of the hangar plate being connected to said mounting plate, the print head being so mounted on the support member that the silk-screen frames of the print heads face outwardly from the center of rotation of the rotatable transport member;

(e) means fixedly connecting the silk-screen frame and squeegee assembly of each said plurality of print heads together so that rotational movement of one of said silk-screen frame and squeegee assembly causes movement in the other of the silk-screen frame and squeegee assembly in the same direction and to the same degree; and (f) means in operative association with one of the silk-screen frame and squeegee assembly of each said plurality of print heads for causing rotational movement of one of said silk-screen frame and squeegee assembly.

12. Apparatus according to claim 11 wherein the means causing rotation of one of said silk-screen frame and squeegee assembly of a print head causes rotation of said squeegee assembly and comprises:

(a) a horizontally disposed skew plate defined by top and bottom surfaces;

(b) a tracking member fixedly connected to the bottom surface of the skew plate defined by front and back edges of arcs of circles having the same center of rotation as the center point of a said well, said front and back edges being further defined by V-shaped edges; and (c) a plurality of freely rotatable rollers extending downwardly from the bottom of the skew plate, said plurality of rollers being arranged in parallel front and back rows of rollers defined by arcs of concentric circles, each said roller being defined by a vertically disposed peripheral surface and a V-shaped groove extending inwardly in said peripheral surface, the V-shaped front and back edges of said tracking member being in operative engagement with the V-shaped grooves in the rollers in the respective front and back rows of rollers.

13. Apparatus according to claim 12 wherein the means causing rotation of the squeegee assembly further comprises:

(a) a horizontally disposed support member defined by top and bottom planar surfaces and by a front edge;

(b) a pair of bearing blocks being mounted on said support member adjacent said front edge and in opposition to one another;

(c) a worm gear being mounted in horizontal disposition in said bearing blocks; and (d) a circular-shaped gear segment being provided in operative association with said worm gear, said gear segment being fixedly connected to said means fixedly connecting said silk-screen frame and squeegee assembly together whereby on rotation of said worm gear the silk-screen frame and squeegee assembly will be caused to rotate together and to the same degree of rotation.

14. Process for the silk-screen printing of the surface of a substrate with a halftone comprising:

(a) providing a plurality of silk-screen print heads each comprising a silk-screen frame and a squeegee assembly and means fixedly connecting the silk-screen frame and squeegee assembly together;

(b) providing a circular-shaped gear segment fixedly connected to the means connecting the silk-screen frame and squeegee assembly together;

(c) providing a worm gear in operative combination with said gear segment; and (d) rotating said worm gear whereby to cause rotation of the silk-screen frame and squeegee assembly together to a predetermined degree of rotation; and (e) silk-screen printing the surface of said substrate.

* * * * *